United States Patent [19]

Nellhaus

[11] Patent Number: 5,031,937

[45] Date of Patent: Jul. 16, 1991

[54] PICTORIAL GUIDANCE/REMINDER SYSTEM FOR MEDICATION

[76] Inventor: Gerhard Nellhaus, 670 Vernon St. #106, Oakland, Calif. 94610

[21] Appl. No.: 516,685

[22] Filed: Apr. 30, 1990

[51] Int. Cl.[5] ..... B42D 15/00

[52] U.S. Cl. ..... 283/52.1; 283/48.1; 283/900

[58] Field of Search ..... 283/52.1, 48.1, 900; 206/534, 532, 538, 459

[56] References Cited

U.S. PATENT DOCUMENTS 3,675,620 7/1972 Baustin ..... 206/534
4,441,739 4/1984 Cluff et al. ..... 283/900
4,556,390 12/1985 Rahn et al. ..... 283/48.1
4,815,767 3/1989 Lambert ..... 283/900

*Primary Examiner*—Douglas D. Watts
*Assistant Examiner*—Hwei-Siu Payer
*Attorney, Agent, or Firm*—Bielen, Peterson & Lampe

[57] ABSTRACT

A pictorial system is devised to assist in the administration of medication, either to self or to another, based on picture stamps of a particulate medication to be taken by or given to a patient at a specified time either over a specified period of time or over an extended and unspecified calendar period. The picture stamps, each reflecting a unit of a medication, are to be pasted into discrete spaces of a sheet, card, label or box cover divided into columns and rows identified by icons for the time of day one or more units of the medication or of the medications are to be taken or given.

10 Claims, 2 Drawing Sheets

PICTORIAL GUIDANCE/REMINDER SYSTEM FOR MEDICATION

BACKGROUND OF THE INVENTION

This invention relates to a visual guidance or reminder system to assist in the administration of medications, whether taken by oneself or given by a caregiver. The pictorial medication system is desirable since many patients must take multiple medications, often at different times of the day. The taking or giving of medications often becomes confusing because of the complex identifying names of the medications, similarities of the containers for the medications, and the circumstance of the patient who may be ill, infirm, or limited in ability to read or to grasp pharmacologic or medical terminology.

The NATIONAL COUNCIL ON PATIENT INFORMATION AND EDUCATION, Washington, D.C. published the following data for the U.S.A. for 1987: (1) Nearly 2.3 billion inpatient and outpatient prescriptions were dispensed; (2) An estimated $23 billion was spent on prescription drugs; (3) The average pharmacy dispensed nearly 27,500 prescriptions that year; (4) In 1986, the Food and Drug Administration received almost 54,000 reports of adverse drug reactions, including 1,347 deaths and 4,1481 hospitalizations; (5) Sales of nonprescription drugs were rising by 6% a year, as two-thirds of Americans self-medicate; (6) Almost 100% of over-the-counter (OTC) medication purchasers used self-selected regimens, and even those taking prescription drugs complied only about 50% of time with the regimens advised.

Among the many problems and complications that arise from the improper timing of medication are ineffectiveness, as with antibiotics or anticonvulsants when doses are missed, or oversedation when doses are taken too close together as with antihistamines. Often, there may be failure to identify the correct medication to be taken or the correct dosage to be administered. Frequently, the very infirmity that requires a patient to take medication, may debilitate judgment and memory.

The interval between doses of a drug, or how frequently during the day a drug must be taken, is determined by its pharmacokinetics, i.e. the rate of absorption, peak blood or tissue level, and rate of degradation and elimination. Thus while the administration of medications is not always critical as to the precise time of the day, it is necessary to take most drugs within readily identifiable periods or at fairly regular intervals. While various dispensers have been devised for periodic dispensing of preselected pills and the like, such devises require preloading by the patient, a caregiver or the pharmacist, and are usually expensive. The visual reminder system of this invention is cost effective, is comprised solely of paper goods, and enables the pharmacist (or less frequently the physician) to quickly and easily select the pictorial representation of the medication to be taken, and to paste such representation on a sheet, in a booklet, on a card, the top of a box, or as a part or tag of a label that can then guide the patient or caregiver in the administration of the medication. Further significant advantages of this pictorial reminder system are that such filled-in sheets may be kept posted in several places about a home such as on the refrigerator door and by the bedside, or kept in a booklet or a card which can be readily carried on one's person as in a purse or wallet. This latter application of the visual guide to medication also permits ready identification of the medication an individual may be taking, which may be of crucial importance to the treating and prescribing physician in the recognition and prevention of polypharmacy and drug-drug interaction, and determination of a suitable regimen for the client. Finally, the ready identification of drugs being taken by a person may be of critical importance in life-threatening situations.

Preferably, the visual depictions of the medications can be directly reproduced on picture stamps from the *Physicians Desk Reference* (PDR) published by Medical Economics Company, from the *Compendium of Drug Therapy*, published by McGraw-Hill Book Company, or from their equivalents in other countries. The icon or stamp of a particular medication preferably includes the name and strength of the drug as additional reminders to the patient or caregiver, providing a learning experience in associating the appearance of the drug with its name and strength.

The principal object of this invention is to provide a convenient and inexpensive means of identifying particular medication and the time of day and period that the medication is to be taken to assist in self-administration or the giving of medications while reducing the risks of improper medication that could result in serious consequences.

SUMMARY OF THE INVENTION

The pictorial guidance or reminder system for administration of medications of this invention is a convenient means to visually identify the medication to be taken, and the dosage, time, and period of administration. This visual reminder system is based on paste-on picture stamps depicting a specific medication in a specific strength, and can be used with a sheet, card, or label having a matrix format with rows and columns that divide the sheet, card, or label into discrete spaces to receive the stamps. The stamps can also be mounted directly on the covers of plastic medication boxes that have a preformed matrix format.

Preferably, the number of rows are selected to conveniently indicate the times of day in which the medication is to be taken. The columns preferably indicate the number of units that make up the total dose at the indicated time as well as the starting and stopping dates of the medication, or alternately, indicate consecutive calendar days of the medication period, or that the medication is to be taken continuously without restriction as to time, or even on a prn—"as necessary" basis. Of course, the format can be reversed with the columns representing the periods during a day in which the medications are to be taken, and the rows dedicated to the dates or days on which the medications are to be administered. The former arrangement has been found to be preferable for a pictorial display that can be arranged in a booklet form of convenient size. While the four icons or ideograms for times of day cover by far most of the commonly prescribed regimens, pictures of a clock showing three or four hour intervals can be used to head the columns when such regimens are desired, as with certain anti-parkinsonian drugs. Thus, while different formats can be selected and the format shown in the detailed description of this invention may be modified by the physician, the essential concept will be the same. This holds true also for application of this visual reminder system in cultures where reading is from right to left, or is vertical rather than horizontal.

The main purpose of this invention is to improve the administration, or the taking or giving of medication by a system that does not require literacy and which can be quickly and easily understood by almost all patients or caregivers because of its intuitive and visual foundation.

Frequently, a patient must self-administer a number of medications that are all dispensed in similar appearing bottles or boxes. The name and strength of the medication and the dose and frequency of administration are often typed on small labels adhered to the cylindrical pill containers or to boxes making accurate reading difficult even for those with unimpaired vision and with medical literacy. Using the visual guidance system of this invention, which is based on picture stamps, enables not only the patient booklet to be filled with picture stamps that visually represent the medication to be taken but also permits a stamp to be applied to the pill container for the medication, to assist in the selection of the proper pill container when taking medications. Furthermore, once the container has been selected and the correct number of pills removed, the visual system which utilizes an accurate pictorial representation of the medication and dosage at a specified time, will provide a final check before the medication is taken by or given to the patient. As described, a sheet or sheets depicting the medication regimen can also be posted at convenient spots around a home, such as on a refrigerator door or by a bedstand, or in nursing/convalescent homes and even in hospitals by a patient's bedside.

As a collateral benefit, the likelihood of misprescribing drugs will be diminished by the visual check that is required by the pharmacist or the physician pasting the medication stamp to the container and to the appropriate locations in the booklet.

In addition, the pictorial system of medication regimen can be applied to a card easily carried on one's person, and even to the printed containers of over-the-counter nonprescription drugs.

DETAILED DESCRIPTION OF THE PREFERRED EMBODIMENTS

The pictorial system of this invention relates to a means to assist in the administration of medication to self or to another based on picture stamps of particular medications to be taken by or given to a patient at a specified time over a day or a number of days. Several embodiments of the system are shown and described to present the system in various forms such that the general concept is readily understood.

Figure 1:
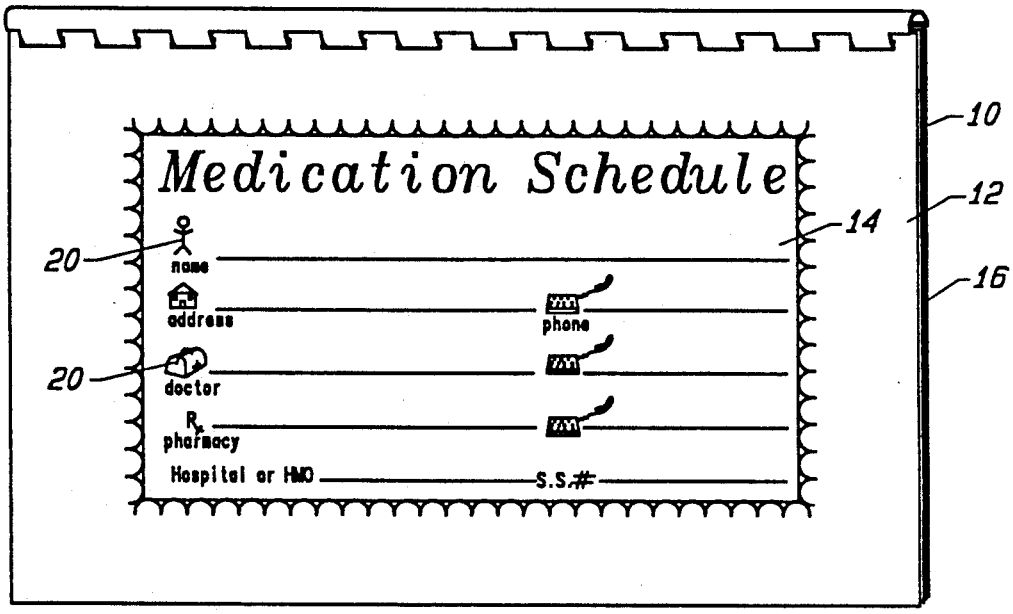
FIG. 1 is a perspective view of the pictorial guidance system in the form of a booklet.
Figure 2:
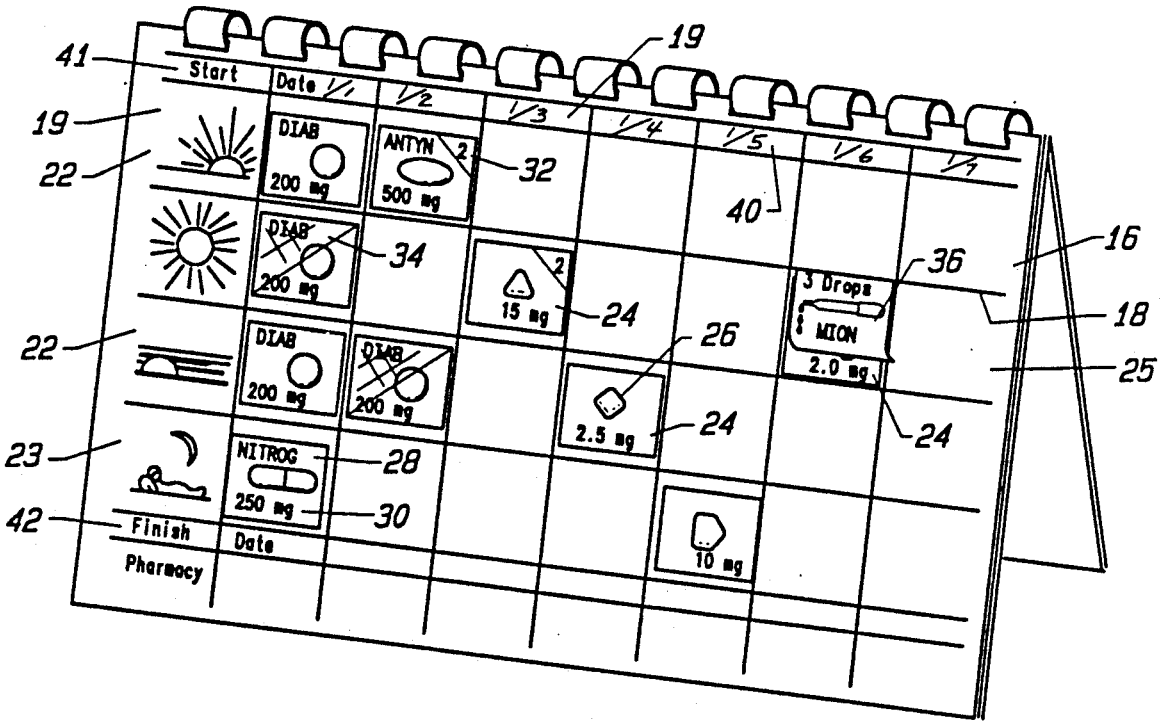
FIG. 2 is a perspective view of the system of FIG. 1 with the booklet opened to a schedule page showing the matrix format and pictorial stamps.

Referring to FIG. 1 and 2, one preferred embodiment of the visual guidance system is shown as a booklet 10 having a cover 12 with a form 14 for conventional patient information, and a number of pages 16 having a matrix format 18 with identification spaces 19 into which information is placed to indicate the time or time of day medication is to be taken. In both the cover form 14 and in the matrix format 18 the use of icons and other pictorial representations is preferred to enable the patient to self-administer or be administered medication by a visual guidance or reminder system. For example, in the cover form 14 are various icon identifiers 20 that represent the patient, his/her address, his/her doctor, etc. Similarly, in the matrix format 18 are icon identifiers 22 to identifying rows to represent the four periods of the day during which particular medications are to be taken by or administered to the patient. The matrix format 18 divides a surface 23 into discrete spaces 25 where identifiers for medications are inserted. The medications are identified by picture stamps 24 which at least include a pictorial representation 26 of the particular drug or other medication to be taken. In addition to the pictorial representation 26 the stamp may preferably include the name 28 of the drug and the strength 30 of the drug printed thereon. Additionally, the stamp can include printed or hand written representations alternately 32 indicating the number of the pill or capsule to be taken, or by cross hatch 34 whether only a half of a unit is to be taken. Furthermore, it is understood that more than a single picture stamp 24 maybe pasted into a single space 25 formed by the matrix format 18 by wetting only a portion of the back of the added stamp or stamps when inserting, such that the stamp can be lifted up to determine one or more other stamps underneath as shown for the eye drop icon stamp 36 in FIG. 2.

In the embodiment of FIG. 2, the matrix format 18 is divided into rows and columns with the icon identifiers 22 representing rows and date markers indicating columns, which may be broken either into days of the week or calendar days as shown by the hand written identifiers 40 along the top of each column. Other information such as a start date marker 41 and a finish date marker 42 may be applied and utilized, particularly where the top column markers are merely days of the week, such as Monday, Tuesday, Wednesday, etc.

Figure 3:
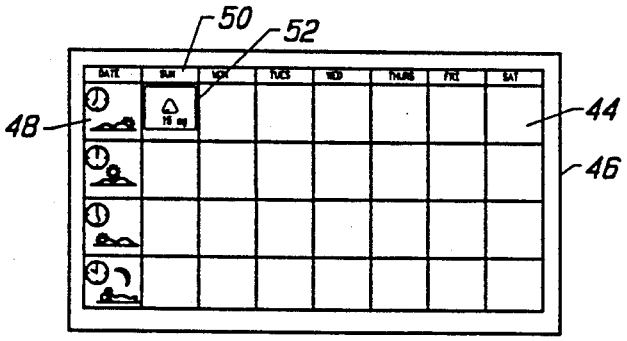
FIG. 3 is a front view of the pictorial guidance system in the form of a wallet-size card.

Referring now to FIG. 3 an alternate embodiment of the pictorial medication system is shown. A matrix format 44 is printed on a card 46 that includes icon identifiers 48 to represent periods during the day, and printed markers 50 representing the days of the week. The icon markers 48 include both a pictorial representation of periods in a day and a pictorial representation of an analog clock. As in the former embodiment, the matrix format is broken into columns and rows with the icon markings for the periods of the day segregating rows and the print markings for the days of the week, identifying the columns. Miniature picture stamps 52 identify the particular medication or medications that are to be taken or administered.

Figure 4:
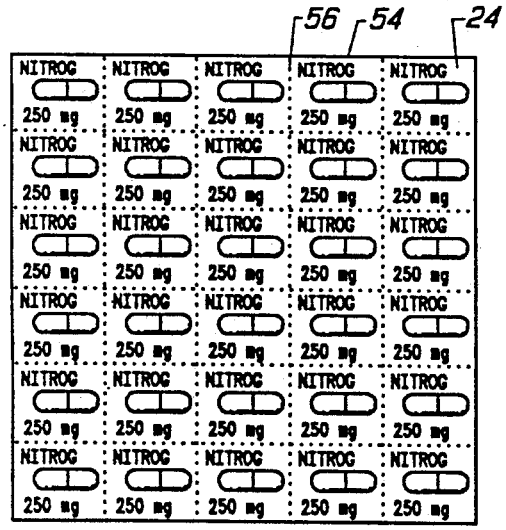
FIG. 4 is a front view of a sheet of identical picture stamps.

The picture stamps 24, 36 and 52 preferably come from a source of sheets, one of which is shown in FIG. 4. Alternately, the stamps can come in rolls or other convenient means for grouping stamps of identical kind. The representative stamp sheet 54 of FIG. 4 includes a plurality of identical stamps which are separated by perforation 56 allowing individual stamps to be easily separated from the sheet and pasted on the surface of one of the various alternative devices for exemplifying the system.

Figure 6:
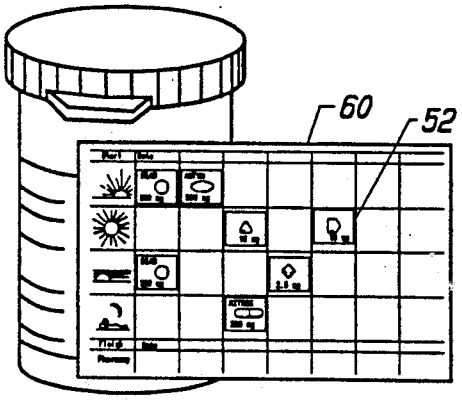
FIG. 6 is a perspective view of a medication container having a matrix format tab with picture stamps pasted thereon.
Figure 5:
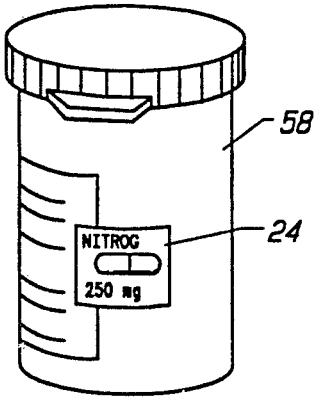
FIG. 5 is a perspective view of a medication container having an identifying picture stamp.

As shown in FIG. 5 a stamp from the stamp sheet 54 can be used on a conventional pharmacy container 58 used to dispense drugs to identify the contents of the container. Alternately, the system can be applied as a tab 60 attached to the container label with the miniature stamps 52 pasted into appropriate boxes of the matrix format to visually represent a medication schedule for the patient for whom the prescription is filled as shown in FIG. 6.

Figure 7:
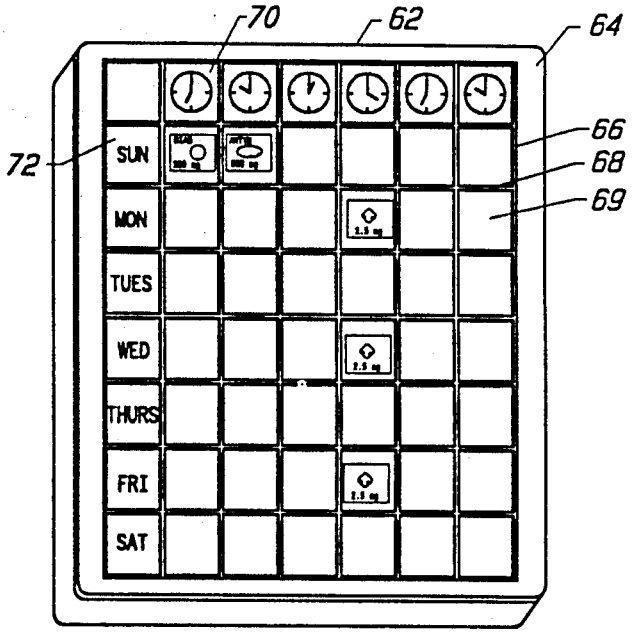
FIG. 7 is a perspective view of a medication box with an integral matrix format having picture stamps and icon stamps pasted thereon.

Although the primary embodiments of this invention have shown the pictorial medication system utilizing one or more printed sheets, it is to be understood that the invention can be embodied in the physical structure of a surface medium such as the top on a medication-containing container 62 as shown in FIG. 7. In the container 62 of FIG. 7, the plastic top 64 is molded with a unitary grid matrix 66 of raised ribs 68 which define a series of boxes 69. If desired, the interior of the container can be similarly divided into separate compartments by dividers (not visible). The top 64 of the container 62 has pasted in certain of the divider icon stamps 70 depicting an analog clock with the clock hands representing certain periods of the day, and, word markers 72 depicting the days of the week. In the particular embodiment shown in FIG. 7 the analog clock stamps 70 designate six columns for six periods during the day in which selected medications should be taken or administered. The word markers 72 indicate the seven days during the week which are available for the taking of the medications. As is evident from the various embodiments shown the concept of this invention can be incorporated in various types of devices to effectively achieve the results desired. Variations in the format can also be made without departing from the concepts disclosed.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A pictorial guidance or reminder system to assist a patient in self-administration of medications or to assist a caregiver in the administration of medications to a patient, comprising:

a surface with a matrix format having rows and columns dividing the surface into discrete spaces adapted to receive paste-on stamps with a first plurality of identification spaces for identifying discrete rows and a second plurality of identification spaces for identifying discrete columns, the first plurality of identification spaces being adapted to identify specified days or dates or even continuous open-ended series of days (with cut-off to be determined by the physician during the course of treatment) and the other plurality of identifying spaces being adapted to identify specific times in a day for taking or giving of medication, and a plurality of different groups of pasteable stamps, each group having a plurality of individual, identical picture stamps visually identifying a select medication, wherein each stamp has depicted thereon an accurate picture of the actual medication visually identified, and wherein each group consists of a different medication, visually identified in each of its stamps, the plurality of groups comprising a source from which selected stamps are removed and pasted in discrete spaces on the surface representing the time and date the pictorially identified medication is to be taken wherein when pasted on such surface, the filled-in surface provides a visual guide or reminder to the patient or caregiver of the type of medication and total dose to be taken or given at a particular time during the day and on a particular date or during a specified or open-ended calendar period.

2. The medication system of claim 1 wherein one of the two pluralities of identification spaces has icon markings identifying discrete periods in the day.

3. The medication system of claim 2 wherein the icon markings include an icon marking visually depicting morning, an icon marking visually depicting mid-day, an icon marking visually depicting evening, and an icon marking visually depicting bed time.

4. The medication system of claim 1 wherein the surface comprises a sheet, sized to a wallet-size card.

5. The medication system of claim 1 wherein the surface comprises a sheet, sized to a calendar-size wall poster.

6. The medication system of claim 1 wherein the surface comprises a plurality of like sheets formed into a booklet for extended medication periods.

7. The medication system of claim 1 wherein the surface comprises the cover of a pill box.

8. The medication system of claim 1, wherein the surface comprises a label sheet attached to a medication container.

9. The medication system of claim 1 wherein the picture stamp groups are perforated sheets with individual pasteable stamps separable by perforations, wherein individual stamps are separated from the sheets by tearing along the perforations.

10. The medication system of claim 1 wherein the pictorial representation of the actual medication is reproduced from one of the authoritative references, *Physician's Desk Reference* and *Compendium of Drug Therapy*.

* * * * *